US006942402B1

(12) United States Patent
Slupe et al.

(10) Patent No.: US 6,942,402 B1
(45) Date of Patent: Sep. 13, 2005

(54) MANUAL IMAGING DEVICE

(75) Inventors: James P. Slupe, Caldwell, ID (US); Terrence M. Shannon, Kuna, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 984 days.

(21) Appl. No.: 09/692,844

(22) Filed: Oct. 19, 2000

(51) Int. Cl.[7] ..... B41J 3/36
(52) U.S. Cl. ..... 400/88; 400/61; 400/70; 347/109
(58) Field of Search ..... 400/61, 62, 70, 400/76, 88; 347/109

(56) References Cited

U.S. PATENT DOCUMENTS

| | | | | |
|---|---|---|---|---|
| 5,240,334 | A | 8/1993 | Epstein et al. | 400/88 |
| 5,311,208 | A | 5/1994 | Burger et al. | 345/163 |
| 5,381,020 | A | 1/1995 | Kochis et al. | 250/566 |
| 5,446,559 | A | 8/1995 | Birk | 358/473 |
| 5,927,872 | A | 7/1999 | Yamada | 400/88 |
| 6,002,124 | A | 12/1999 | Bohn et al. | 250/208.1 |
| 6,071,368 | A | 6/2000 | Boyd et al. | 156/240 |
| 6,312,124 | B1 * | 11/2001 | Desormeaux | 347/109 |

* cited by examiner

*Primary Examiner*—Minh Chau
(74) *Attorney, Agent, or Firm*—Gregg W. Wisdom

(57) ABSTRACT

An embodiment of a manual printer is particularly well suited for forming images on the surface of uneven objects. The embodiment of the manual printer includes a microprocessor for controlling its operation. Image data is stored in RAM and the firmware for controlling the operation of the microprocessor is stored in ROM. A print head interface generates drive signals for a print head using data received from the microprocessor. A signal is generated by an emitter. A receiver in the manual printer receives the signal. The signal includes an x-component, a y-component, and a z-component. The microprocessor determines the position of the manual printer with respect to a reference location using the components of the signal. A distance sensor in the manual printer measures the distance of the print head from the surface of the object. A tilt sensor in the manual printer measures an angle between a longitudinal axis in the manual printer and the surface of the object. An acceleration sensor in the manual printer measures the acceleration resulting from movement by a user. A display in the manual printer allows the user to preview and select images for performing an imaging operation. A user begins forming an image by depressing a button while moving the manual printer over the surface of the object. If the microprocessor determines that position, distance, angle, and acceleration are within allowable limits, ink is ejected from the print head to form the image.

11 Claims, 8 Drawing Sheets

MANUAL IMAGING DEVICE

FIELD OF THE INVENTION

This invention relates to the formation of images using an image forming apparatus. More particularly, this invention relates to the formation of images manually.

BACKGROUND

There are a variety of objects, other than standard media (such as paper, overhead transparencies, labels, or the like) upon which it is desired to place images. These objects may include such things as odd sized or shaped media, fabric, objects having very large dimensions, three dimensional objects, such as objects formed from wood, ceramic, metal, or the like. Typically, these types of objects are not easily moved through the media path of an imaging device such as an inkjet printer or an electrophotographic printer. In addition, the surfaces of these types of objects can be irregular.

One way in which images have been placed on objects such as these is to print the image on a transparent film and place the film onto the surface of the object. However, this technique does not work particularly well on an object having an irregular surface. A need exists for an image forming apparatus having the capability to more effectively place an image on the surface of these types of objects.

SUMMARY OF THE INVENTION

Accordingly, a method for forming an image includes locating a manual imaging device adjacent to an object. The method also includes receiving a signal in the manual imaging device and determining a position of the manual imaging device relative to a reference location using the signal. In addition, the method includes forming the image on the object while parameters related to the manual imaging device equal or exceed minimum criteria.

A manual imaging system includes an emitting device configured to emit a signal and a receiving element arranged to receive the signal. The manual imaging system also includes a memory to store image data and an imaging mechanism configured to place colorant onto an object according to data related to the image data. Furthermore, the manual imaging system includes a processing device arranged to receive a representation of the signal and configured to selectively send the data to the imaging mechanism using the representation and selectively receive the image data from the memory.

A manual imaging device includes a receiving element arranged to receive a position signal. The manual imaging device also includes a memory to store image data. Furthermore, the manual imaging device includes an imaging head configured to place ink onto an object according to a plurality of drive signals and an imaging head interface arranged to receive data related to the image data and configured to generate the plurality of drive signals using the data. In addition, the manual imaging device includes a processor arranged to receive a representation of the position signal and configured to selectively send the data to the imaging head interface using the position signal and selectively receive the image data from the first memory.

DESCRIPTION OF THE DRAWINGS

A more thorough understanding of embodiments of the manual imaging device may be had from the consideration of the following detailed description taken in conjunction with the accompanying drawings in which.

DETAILED DESCRIPTION OF THE DRAWINGS

Although an embodiment of the manual imaging device using an inkjet print head will be disclosed, it should be recognized that other types of print heads having the capability to place material for forming an image onto an object could be used. For example, a print head having the capability to directly place toner onto the object could be used. Where toner is used, a hand held fusing device could be used to fix toner onto the object. Or, the object could be placed inside an oven designed to heat the toner and the object sufficiently for fixing the toner to the object. Although the embodiment of the manual imaging device disclosed includes the capability to form color images, it should be recognized that embodiments of the manual imaging device could be constructed to form monochrome images using the principles disclosed in this specification.

Figure 1A:
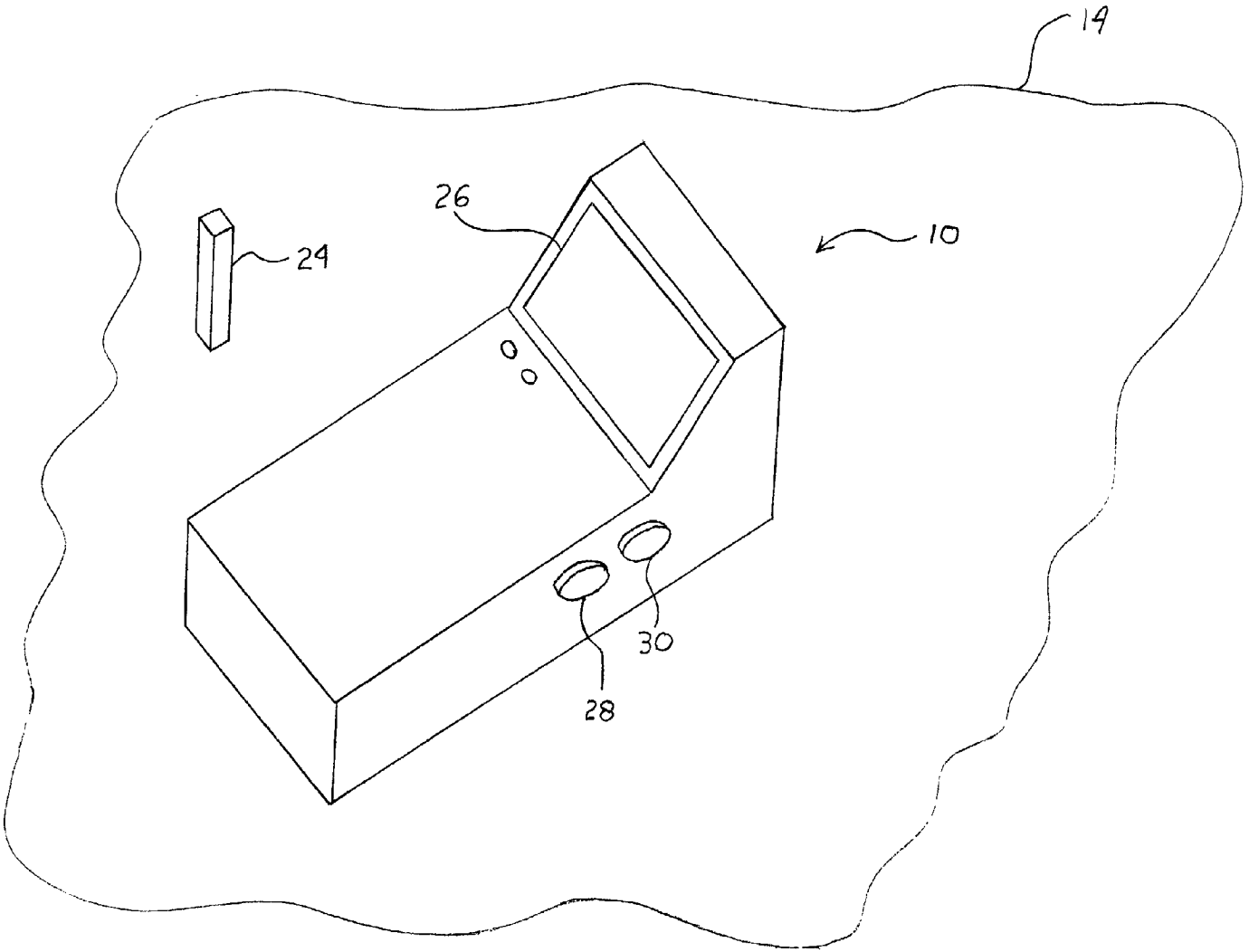
FIGS. 1A and 1B show two views of an embodiment of a manual printer.
Figure 1B:
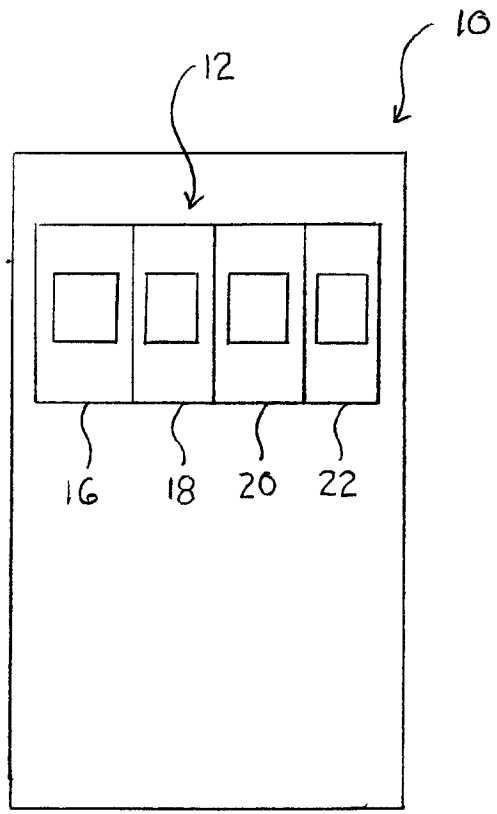

Shown in FIG. 1A is simplified perspective drawing of an embodiment of the manual imaging device, manual printer 10. Shown in FIG. 1B is a simplified bottom view of manual printer 10. An embodiment of an imaging head, print head 12, included in manual printer 10 places colorant on the surface of object 14. Object 14 may have a wide range of surface contours or textures ranging from uneven and rough to flat and smooth. In manual printer 10, print head 12 makes use of inkjet print cartridges. In particular, print head 12 includes a cyan cartridge 16, magenta cartridge 18, yellow cartridge 20, and black cartridge 22.

An embodiment of an emitting device, such as emitter 24, is used by manual printer 10 to determine its position over object 14 onto which the image is to be placed. Data defining an image is stored within manual printer 10. This data could, for example, be downloaded from a computer or, memory devices containing data could be loaded into manual printer 10. These memory devices could include miniaturized hard disk drives or flash memory cards. The data defining an image to be placed on object 14 could be provided to manual printer 10 as raster data defining the image pixel by pixel or, the data could be provided to manual printer 10 in the form of a higher level printer control language. In this case, manual printer 10 would generate the raster data defining the image using the higher level printer control language.

For the case in which the data is downloaded from the computer, one option for downloading data from the computer is to connect the manual printer 10 to the computer and download the data in a batch mode. Another option is to connect manual printer 10 to the computer and download the data to manual printer 10 as the image is formed. However, a difficulty with this method is in transferring the data defining the image rapidly enough from the computer to manual printer 10 over a cable or infra-red link to allow manual printer 10 to operate in a suitable manner. It should be recognized, however, that an embodiment of manual printer 10 could be configured to perform an imaging operation while data is transferred. This embodiment would use a data transfer protocol adapted for high speed transfer of data. In addition, this embodiment of manual printer 10 could be configured to not place colorant on the pixels of object 14, if, when manual printer 10 is adjacent to those pixels on the surface of object 14, corresponding image data is not available for those pixels. Instead of placing colorant, manual printer 10 stores the pixel addresses. In future passes adjacent to those pixels, when the corresponding image data is available, manual printer 10 places colorant on those pixels.

Manual printer 10 includes LCD display 26. LCD display 26 allows a user to preview and select an image that will be formed on object 14 before beginning the process of forming the image. Manual printer 10 may include sufficient memory capacity to store data defining more than one image. The user could scroll through these images, sequentially displaying them on LCD display 26, and select the image to be formed on object 14.

A user forms an image on manual printer 10 by moving manual printer 10 over the surface of object 14 while depressing button 28. Button 28 is closes by the user when it is desired to begin forming the image on the surface of object 14. Depressing button 28 signals manual printer 10 that the image is to be placed on the surface of object 14.

As previously mentioned, emitter 24 generates a signal used by manual printer 10 to determine its position relative to object 14. Before forming the image on object 14, a reference point is established for manual printer 10. This reference point allows manual printer 10 to determine its location relative to a corner of the image that will be placed on object 14. In general, the reference point could correspond to any point located within or near the image that is to be formed. The user and manual printer 10 account for the known position of the reference point in determining, respectively, the location at which to begin placing the image and the location of manual printer 10 with respect to the image when button 30 is depressed. A choice for the reference point that is convenient and contributes to the ease of use of manual printer 10 is at one of the corners of the image. This will allow the user to easily gage the position of the resulting image on the surface of object 14.

The user establishes the reference point by locating manual printer 10 over object 14 at the desired reference point. The user closes button 30 to signal manual printer 10 that it is located at the reference point. In response, manual printer 10 measures the signal provided by emitter 24 to determine its values for all three dimensions at the reference location. With this information, manual printer 10 can determine its position in three dimensions as it is moved over the parts of object 14 on which the image will be placed.

After the user has previewed and selected the image that will be formed on object 14 and established the reference point, the image can be formed on object 14. The user begins placing the image on object 14 by depressing button 30. By depressing button 30, the user allows manual printer 10 to begin depositing colorant on object 14 according to the raster data specifying the image. As the user moves manual printer 10 over object 14, manual printer 10 determines its location relative to the reference point and according to the raster data specifying the image, fires the appropriate cartridge or cartridges in print head 12 to place colorant on object 14. Manual printer 10 includes the capability to adjust the firing of cartridges in print head 12 to compensate for variations in the rate and direction of movement of manual printer 10 over object 14 using the signals generated by emitter 24.

Figure 2A:
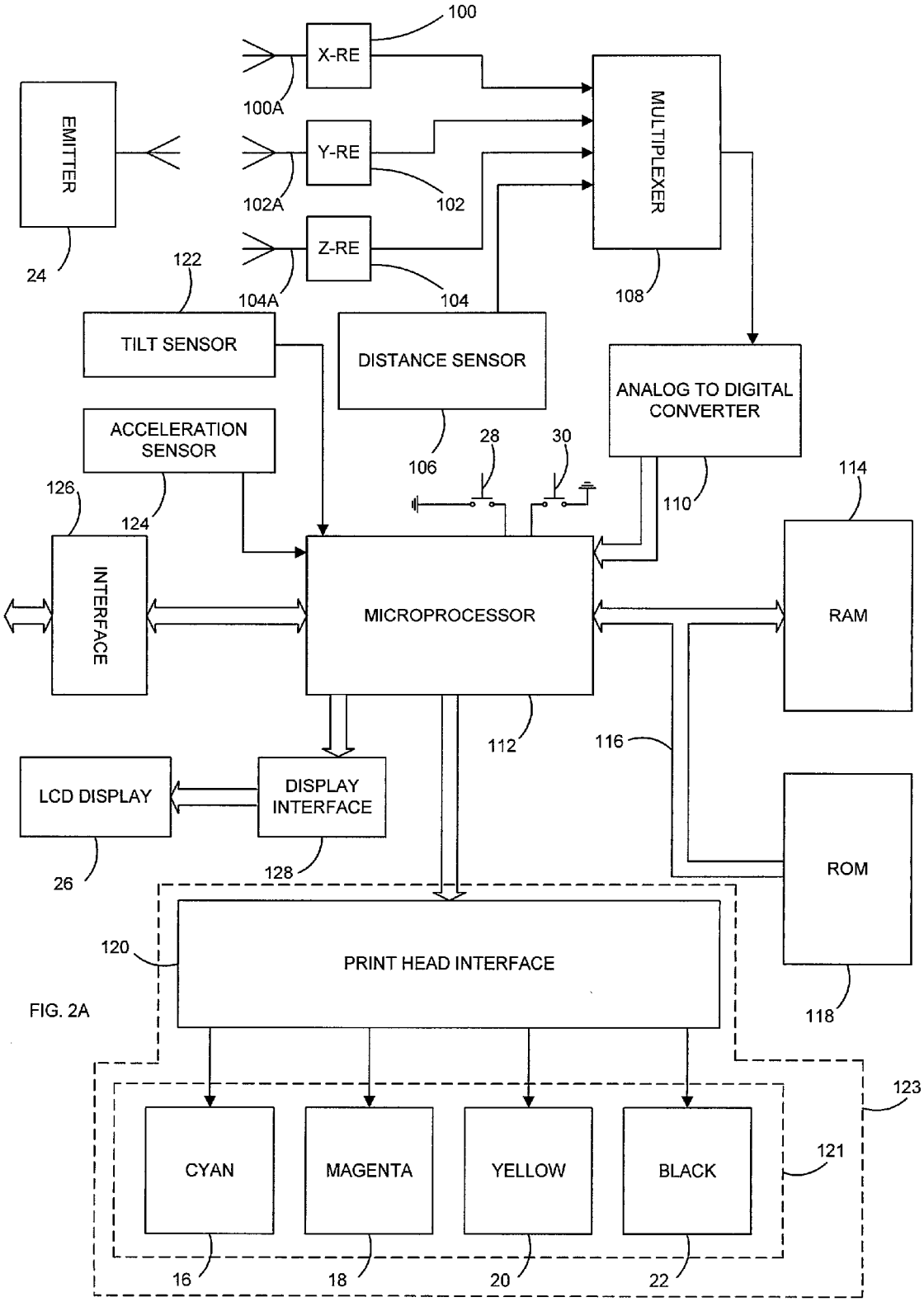
FIG. 2A shows a block diagram of an embodiment of the manual printer.

Shown in FIG. 2A is a simplified block diagram of manual printer 10. Manual printer 10 includes an embodiment of receiving elements to receive the signals generated by emitter 24. Manual printer 10 includes the capability to determine its location relative to the reference point using the signals generated by emitter 24. Receiving element (RE) 100 is configured to receive the signal generated by emitter 24 corresponding to the X axis. Receiving element (RE) 102 is configured to receive the signal generated by emitter 24 corresponding to the Y axis. Receiving element (RE) 104 is configured to receive the signal generated by emitter 24 corresponding to the Z axis. Each of receiving elements 100–104 are coupled, correspondingly, to antennas 100*a*–104*a*. Included in each of receiving elements 100–104 are filters for conditioning the signals received from antennas 100*a*–104*a*. The conditioning of the signals performed by receiving elements 100–104 may include filtering to more accurately detect the signal received from emitter 24 for the respective axis relative to the other signals received by the corresponding antennae 100*a*–104*a*. In addition to the signals from which manual printer 10 determines its position relative to the reference point, manual printer 10 includes an embodiment of a sensor, such as distance sensor 106, to generate a signal related to a position of manual printer 10 above object 14.

The outputs provided from receiving elements 100–104 and distance sensor 106 are coupled to the inputs of multiplexer 108. Multiplexer 108 allows selection of one of the four signals provided to it for input to analog to digital converter (A/D) 110. A/D 110 converts the analog signal provided to it from multiplexer 108 into a corresponding digital value. The digital value generated by A/D 110 is coupled to a processing device, such as microprocessor 112. Microprocessor 112 performs the computations on the values received from A/D 110 necessary to determine the position of manual printer 10 relative to the location of emitter 24 and object 14. Emitter 24 is positioned relative to object 14 by the user. Or, alternatively, emitter 24 is in a fixed location and object 14 is moved into position near emitter 24.

The signals generated by emitter 24 corresponding to the X axis, Y axis, and Z axis may be differentiated in several ways. Emitter 24 could be configured to generate signals having different frequencies for the X axis, the Y axis, and the Z axis. Receiving elements 100–104 would then filter the signals received from emitter 24 based upon frequency to form the signals to correspond to the X axis, the Y axis, and the Z axis. Another way in which to differentiate the signals generated by emitter 24 would be based upon polarization. The signals generated by emitter 24 corresponding to each axis would be generated with different polarizations. To receive the signals of differing polarizations, the antennae 100*a*–104*a* would have a design and orientation to preferentially receive the corresponding polarized signal emitted from emitter 24.

An alternate implementation of emitter 24 would have the capability to emit signals from at least two separate positions relative to object 14. To determine the position of manual printer 10 relative to the reference point, each of receiving elements 100–104 would have the capability to measure a phase difference between the signals received from the separate positions and the strength of the signals to determine the position of manual printer 10 relative to the reference point. The phase difference values and the signal strength values for each of the three axes would be converted to digital values and supplied to microprocessor 112. Microprocessor 112 would use the phase values and the signal strength values to compute the position of manual printer 10 relative to the reference point.

It should be recognized that there are other alternatives for determining the position of manual printer 10 relative to object 14. For example a frame could be placed around object 14. Manual printer 10 could include optical or sonic emitting devices and receivers that would reflect light or sound off the frame to determine the position of manual printer 10 with respect to object 14. Using the signals provided by the receivers, microprocessor 112 would calculate the position of manual printer 10 relative to the reference point.

A memory device, such as random access memory (RAM) 114, is coupled to microprocessor 112 through bus 116. Bus 116 includes the necessary lines for transferring data, address information, and control information between microprocessor 112 and RAM 114 and ROM 118. RAM 114 is used to store data representing the images that will be placed on object 14. RAM 114 may be of a size sufficient to hold the data for part of an image or of a size sufficient to hold data for multiple images. A memory device, such as read only memory (ROM) 118, is coupled to microprocessor 112 through bus 116. ROM 118 stores the firmware used by microprocessor 112 to operate manual printer 10. The operations performed by microprocessor 112 in executing the firmware stored in ROM 118 include loading and storing data corresponding to images, determining the position of manual printer 10 relative to the reference point, and providing the necessary signals to an embodiment of a imaging head interface, print head interface 120.

Microprocessor 112 generates signals supplied to print head interface 120 that are used to fire cyan cartridge 16, magenta cartridge 18, yellow cartridge 20 and black cartridge 22 as necessary to form an image on object 14 corresponding to the data defining the image stored in RAM 114. Using the signals received from microprocessor 112, print head interface 120 generates drive signals that fire the nozzles in each of the print heads in cyan cartridge 16, magenta cartridge 18, yellow cartridge 20, and black cartridge 22 necessary to form the image on object 14. The cartridges form an embodiment of an imaging head, imaging head 121. Imaging head 121 is included with print head interface 120 in an embodiment of an imaging mechanism, imaging mechanism 123.

The nozzles in the cartridges are fired by causing current to flow through resistors corresponding to each of the nozzles. The heat generated by the resistors causes ink to vaporize and eject through the nozzles onto object 14. The resistors and the switching circuitry for driving the nozzles are located on print head 12. The circuitry for translating signals generated by microprocessor 112 defining the colors that are to be placed on locations on object 14 is located within print head interface 120. The translation involves converting the signals provided by microprocessor 112 into signals that drive the switching circuitry within print head 12. More information regarding the design of print head 12 and print head interface 120 can be found in U.S. Pat. No. 5,541,629 entitled PRINT HEAD WITH REDUCED INTERCONNECTIONS TO A PRINTER, U.S. Pat. No. 5,883,650 entitled THIN-FILM PRINT HEAD DEVICE FOR AN INK-JET PRINTER, U.S. Pat. No. 6,084,617, entitled NARROW BODY INKJET PRINT CARTRIDGE HAVING PARALLEL CONFIGURATION, and U.S. Pat. No. 6,039,438, entitled LIMITING PROPAGATION OF THIN FILM FAILURES IN AN INKJET PRINT HEAD, each which are incorporated by reference into this specification in their entirety.

An embodiment of a sensor, such as tilt sensor 122, is coupled to microprocessor 112. Tilt sensor 122 measures the orientation of manual printer 10 with respect to the surface of object 14. Microprocessor 112 uses the output from tilt sensor 122 to determine the angle between a plane formed by a longitudinal axis of manual printer 10 and the minor axis perpendicular to it (ideally this plane is orientated parallel to the horizontal when the surface of object 14 on which the image is to be placed is generally horizontal) and the horizontal. With the computed angle, microprocessor 112 determines if the orientation of manual printer 10 with respect to the horizontal is sufficiently close to parallel to allow formation of the image. If manual printer 10 is orientated sufficiently close to parallel, then microprocessor 112 permits the ejection of a colorant, such as ink, from print head 12. Although the operation of manual printer 10 has been discussed in the context of placing an image on the surface of object 14 that is generally horizontal, it should be recognized that the surface of object 14 on which the image will be placed could have any orientation with respect to the horizontal. For example, object 14 could be orientated so that the surface onto which the image will be placed is generally vertical.

Manual printer 10 can still operate to form an image on object 14 even if the plane is not orientated parallel to the horizontal. If manual printer 10 is tilted with respect to the horizontal, microprocessor 112 compensates for this tilt in forming the image on object 14. With the computed angle between the plane and the horizontal, microprocessor 112 determines the nozzles to fire to form the part of the image corresponding to the area of object 14 over which manual printer 10 is positioned. Consider the case in which the plane is orientated substantially parallel to the horizontal. In that case, ink drops ejected from print head 12 travel in a direction substantially perpendicular to the plane and impact the surface of object 14 in a pattern that substantially matches the pattern of the nozzles in print head 12 that ejected ink. Now consider the plane of manual printer 10 tilted with respect to the horizontal. In that case, ink drops ejected from print head 12 travel in a direction that is not substantially perpendicular to the plane of manual printer 10. The resulting pattern of the ink drops upon the surface of object 14 is a compressed version of the pattern of nozzles that ejected ink in the dimension or dimensions corresponding to the direction of the tilt. The pattern formed is essentially the vertical projection of the pattern of the nozzles that were fired onto object 14 by manual printer 10 in the direction of the tilt. To compensate for the projection of the nozzle pattern onto the surface of object 14, microprocessor adjusts the firing of the nozzles for the corresponding portion of the image to be formed on object 14.

Accelerometer 124 measures the acceleration experienced by manual printer 10 and generates a signal corresponding to the measured acceleration. The signal from accelerometer 124 is coupled to microprocessor 112. The measurement from the accelerometer is used to control the rate at which ink is placed onto object 14.

In a standard inkjet printer, the rate of movement of the print head relative to media is substantially constant. Consider, for example, placement of a uniform pattern onto a unit of the media. Because of the substantially constant rate at which the print head moves relative to the media, the average firing rate of the print head (and therefore the average flow rate of ink out of the print head) will remain substantially constant. Now consider a user moving manual printer 10. There can easily be substantial variations in the rate at which a user moves manual printer 10 over object. To compensate for variations in the rate at which manual printer 10 is moved over object 14, microprocessor 112 uses the signal provided by accelerometer 124 (as well as the computed position relative to the reference point) to compensate for variations in the rate at which manual printer 10 is moved over object 14. When the signal provided by accelerometer 124 to microprocessor 112 indicates a change in acceleration (in the horizontal plane), microprocessor 112 will account for the change in acceleration in the signals provided to print head interface 120. An increase in acceleration (corresponding to an increase in the rate at which manual printer 10 moves over object 14) will increase the average firing rate of the nozzles in print head 12, while a decrease in acceleration (corresponding to a decrease in the rate at which manual printer 10 moves over object 14) will decrease the average firing rate of the nozzles in print head 12.

Microprocessor 112 can receive data defining an image through interface 126 from a computer or another type of device that can store data defining the image. LCD display 26 receives data for displaying an image, displaying a selection menu, or displaying messages to a user, through display interface 128. Microprocessor 112 generates the data supplied to display interface 128 for display of an image, selection message, or menu.

Although the embodiment of manual printer 10 disclosed in FIG. 2 makes use of accelerometers to measure changes in the rate at which manual printer 10 moves relative to object 14, acceleration could be computed from the signals generated by receiving elements 100–104. Using the signals from receiving elements 100–104 alone to compute acceleration may not provide the same degree of accuracy as in using accelerometer 124 in conjunction with the signals from receiving elements 100–104.

Figure 2B:
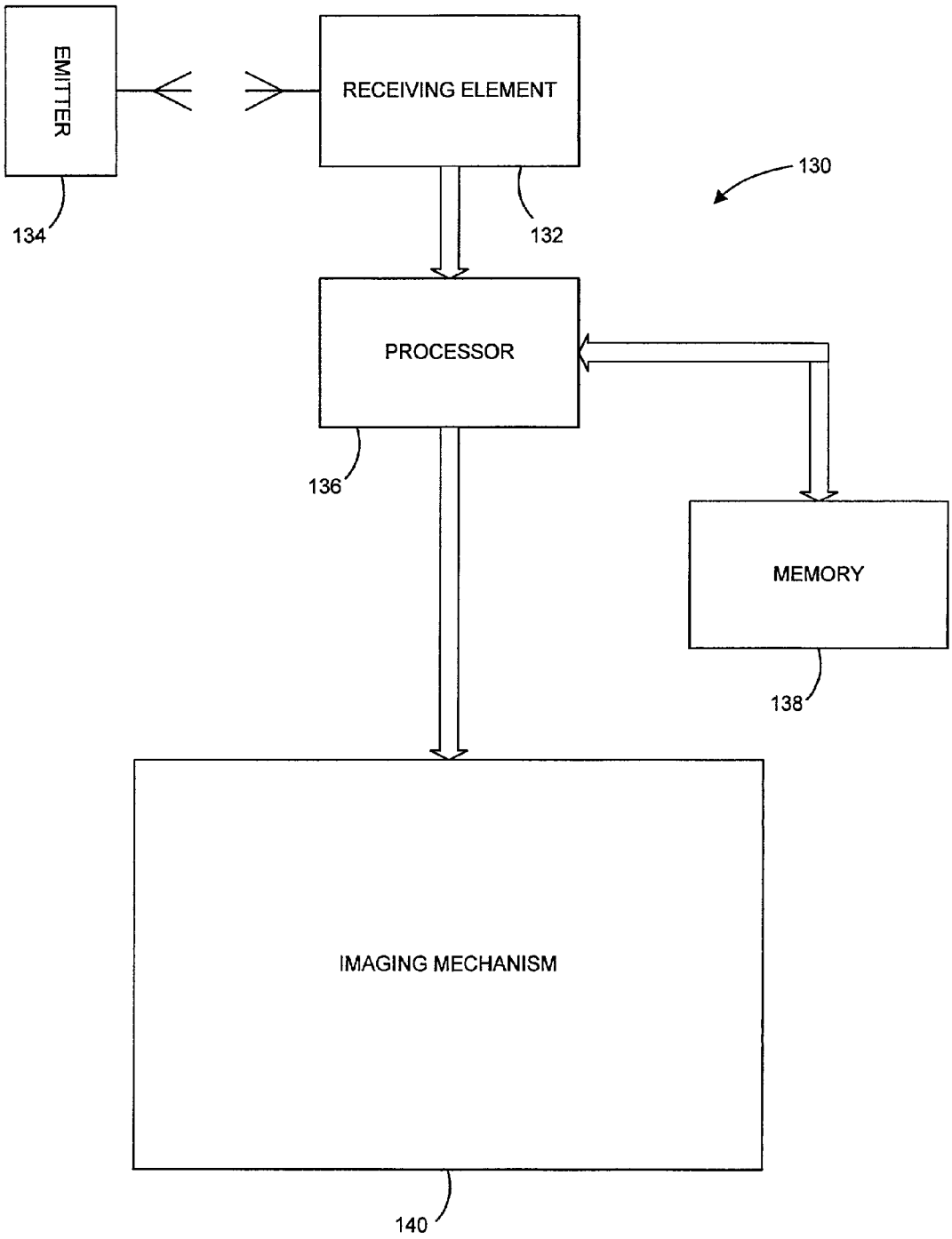
FIGS. 2B and 2C show block diagrams of alternative embodiments of the manual printer.

Shown in FIG. 2B is a simplified block diagram of an alternative embodiment of a manual imaging device, manual printer 130. Manual printer 130 is a simplified embodiment of the manual imaging device. Manual printer 130 includes receiving element 132 for receiving a signal generated by emitter 134. The signal generated by emitter 134 includes a component corresponding to the x axis, the y axis, and the z axis. The signal could be an analog signal or it could be a digital signal The components of the signal could be differentiated by having different carrier frequencies (with the information modulated onto the carrier using any of the available modulation schemes), by time division multiplexing, or some other encoding scheme. Receiving element 132 includes the capability to separate the components of the signal generated by emitter 134. This separation could be accomplished through the use of bandpass filtering (implemented using either analog or digital techniques). Alternatively, the separation could be accomplished by assigning time intervals to each of the components so that, for example, at periodic intervals the signal would carry information corresponding to, successively, the x axis, the y axis, and the z axis.

A processing device, such as processor 136, receives a representation of the signal from receiving element 132. That representation could be a digitized version of the signal (with digital values for each of the components) or it could be an analog version of the emitted signal. If the representation of the signal received by processor 136 is an analog version of the emitted signal, processor 136 would include the hardware to digitize the analog version. Processor 136 determines the position of manual printer 130 using the representation of the signal.

Memory 138 stores image data that corresponds to the image that will be placed onto object 14. Processor 136 selectively loads the image data for forming the image from the memory. Using the representation of the signal, processor 136 sends the appropriate image data to an embodiment of an imaging mechanism, imaging mechanism 140. Imaging mechanism 140 includes the hardware necessary to convert the image data received from processor 136 into drive signals used to actuate hardware that deposits colorant onto object 14. The hardware included imaging mechanism could include, for example, an imaging head interface to generate drive signals from the image data. The drive signals would be coupled to an imaging head included in the imaging mechanism. The imaging head would place the colorant onto object 14 according to the drive signals received from the imaging head interface.

Figure 2C:
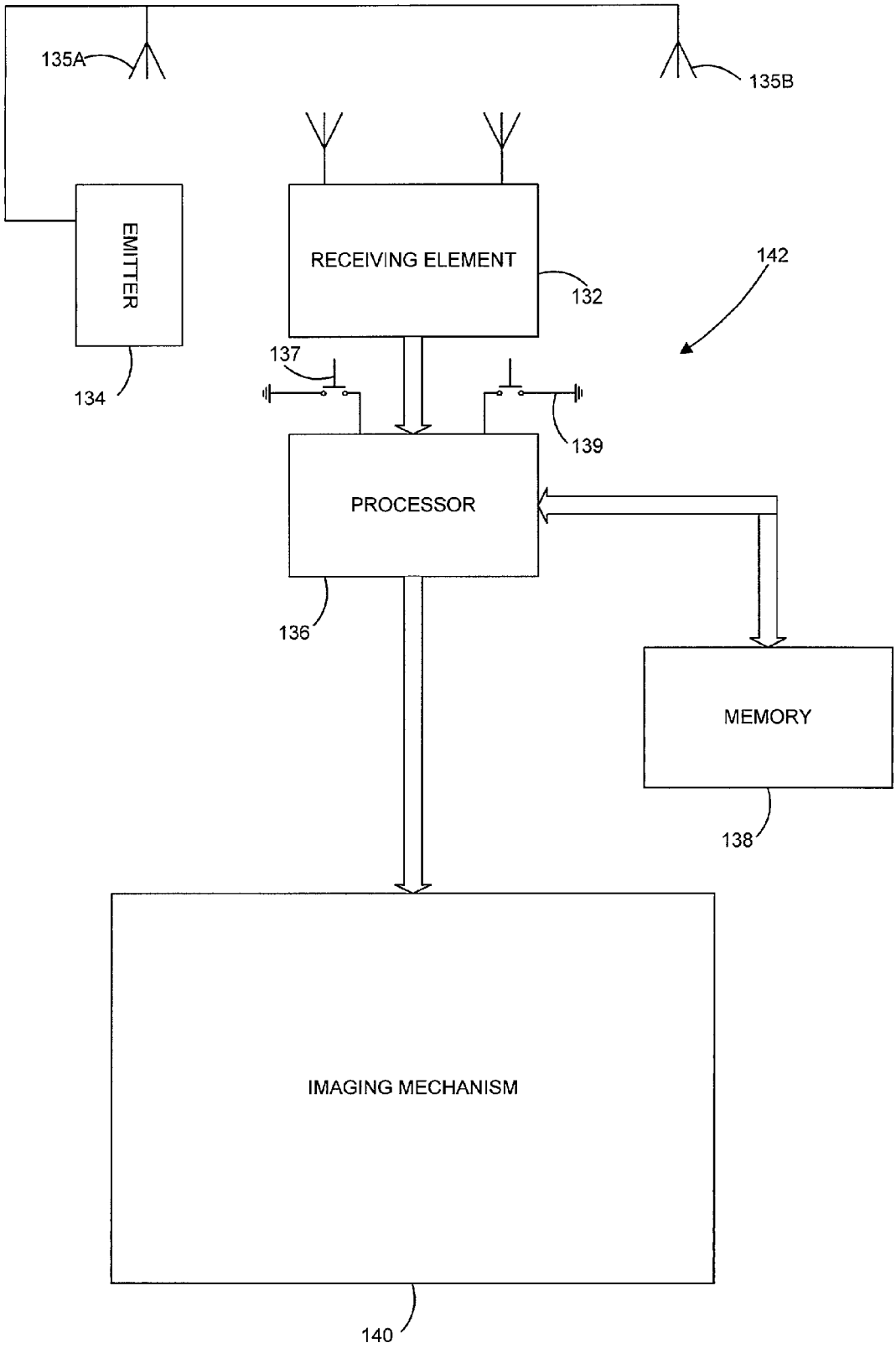

Shown in FIG. 2C is an alternative embodiment of the manual imaging device, manual printer 142. Manual printer 142 receives a signal having at least two components. The accuracy with which manual printer 142 can determine its position is related to the number of components forming the signal. As the number of components emitted from different locations increases, the accuracy with which manual printer 142 is able to determine its position increases. The emitting devices used to emit components of the signal depend upon the kind of energy used in the signal. Different kinds of radiated energy could be used for the signal. For example, the emitting devices could emit a radio frequency signal (including millimeter wave and microwaves), visible light, infrared light, or ultra-violet light, x-rays, or even sonic energy. If radio frequency energy was used the emitting devices would include radiators such as antennas. If sonic energy was used the emitting devices would include radiators such as speakers.

There are several ways in which manual printer 142 may determine its position using the components of the signal. A first way is for each of the components transmitted by the emitting devices to include highly accurate time identification information. Manual printer 142 compares the time identification information included within each of the signal components to a highly accurate synchronized time standard. The difference between the time standard and the time identification information in each of the signal components is a measurement of the distance of manual printer 142 from the emitting devices for the respective components of the signals. Using the time differences generated from the time identification information of the respective signal components and the time standard, manual printer 142 determines its position. The time identification information could take the form of a time stamp encoded into the emitted signal component and the time standard would measure the passage of time on manual printer 142. Or, the time identification information could be derived by comparing the phase of each of the signal components to a reference frequency (or frequencies) in manual printer 142. This reference frequency would be phase locked with the source used to generate the signal components. Measuring the phase delay between the received signal component and the reference frequency provides a measure of the time differences (corresponding to the time required for the signal component to propagate from the respective emitter to manual printer 142). The time differences are then used to determine the position of manual printer 142.

A second way in which manual printer 142 can determine its position uses a transmitter in manual printer 142. The transmitter sends out a signal that is received by each of the emitting devices. In response, each of the emitting devices generates its respective signal component and transmits it back to manual printer 142. For each of the components, manual printer 142 determines the time between sending its signal and receiving the signal components from the emitting devices. These time difference values indicate distance from the emitting devices and are used by manual printer 142 to determine the position of manual printer 142.

Consider an implementation of manual printer 142 that uses two components for the received signal. One of the components is transmitted through an emitting device, such as antenna 135A, and the other component is transmitted through an emitting device, such as antenna 135B. Receiving element 132 receives the two signal components through a pair of antennas positioned at different locations on manual printer 142. By receiving the two signal components through the two antennas, manual printer 142 can determine its orientation in space. Processor 136 computes the position of manual printer 142 over an object using the two components of the signal. The position of manual printer 142 is determined to at least within one half of a pixel. In addition to determining position, processor 136 computes velocity and acceleration of manual printer 142 using the two components of the signal.

To locate an image on the object, the user establishes a reference location on the object, corresponding to a corner of the image (where the image boundary is defined by a rectangle). To establish the reference location the user positions manual printer 142 at the reference location and closes switch 137. For processor 136 to position and size the image on the object, the position of at least one corner in addition to the reference location is determined in a similar fashion. To allow the user to more easily visualize how the image will be located and sized on the object, the firmware controlling the operation of processor 136 could be configured to allow the user to select four image corners (the reference location and the location of the three other image corners) of the image to locate and size the image.

Using the four user selected image corners, processor 136 executes an algorithm to determine the best fit of the image to the four user selected corners. The positioning of the image is fixed with respect to the reference location. However, the three other user selected image corners will likely not correspond exactly to the position of the image corners necessary to prevent distortions of the image. If all of the user selected image corners were used to establish the boundaries of the image, the image would likely be distorted. The boundaries formed by the user selected image corners would be unlikely to form an exact rectangle and the aspect ratio of the rectangle would be unlikely to equal that defined by the image data.

To form an image on the object, the user moves manual printer 142 adjacent to the object while closing switch 139. As manual printer 142 is moving, processor 136 determines if imaging mechanism 140 is within the image boundary. The image data is stored in memory 138. If manual printer 142 is within the image boundary, then processor 136 loads the appropriate image data from memory 138 and sends the image data to imaging mechanism 140. The image data sent to imaging mechanism 140 corresponds to the portion of the image that is to be placed onto the location on the object adjacent to imaging mechanism 140.

The image data to provide to imaging mechanism 140 is determined using the computed position and velocity of manual printer 142. Where imaging mechanism 140 includes an inkjet print head, an imaging head interface will generate drive signals to fire nozzles in the print head according to the image data. The image data provided to the imaging head interface is selected by processor 136 so that the correct nozzles in the print head are fired to create the correct portion of the image on the surface of the object adjacent to imaging mechanism 140. While manual printer 142 is moving during an imaging operation, processor 136 computes the velocity. If the velocity of manual printer 142 exceeds a maximum allowable value, processor will stop providing image data to imaging mechanism 140.

To form the image, the user moves manual printer 142 adjacent to the object in a manner similar to sweeping a paint brush across a surface. Before placing colorant for a portion of the image, processor 136 determines if colorant has already been placed for that portion of the image. Once colorant has been placed on pixels, additional colorant is not placed onto those pixels again if manual printer 142 is moved adjacent to that portion of the object. The user may stop the imaging operation by opening switch 139 or moving manual printer 142 outside of the image boundary.

The algorithm executed by processor 136 to determine the correct image data to send to imaging mechanism 140 for manual printer 142 located at a specific location and moving at a specific velocity can be optimized depending upon the contour of the surface of the object on which the image will be formed. For example, on a surface having a relatively high rate of curvature, the resulting appearance of the image formed onto the surface will be affected by the surface curvature. If colorant is placed onto the surface assuming it is a planar surface, distortion of the image will result relative to placing the image on a planar surface. The algorithm used for the placement of colorant onto pixels of the image could be modified to account for the surface contour. Additional calibration steps would be performed to estimate the surface contour. The algorithm would use the estimate of the surface contour to adjust the placement of colorant onto the surface to compensate for the surface contour. By adjusting the placement of colorant depending upon the surface contour, images can be formed on a wide variety of irregularly shaped objects without excessive distortion.

Figure 3A:
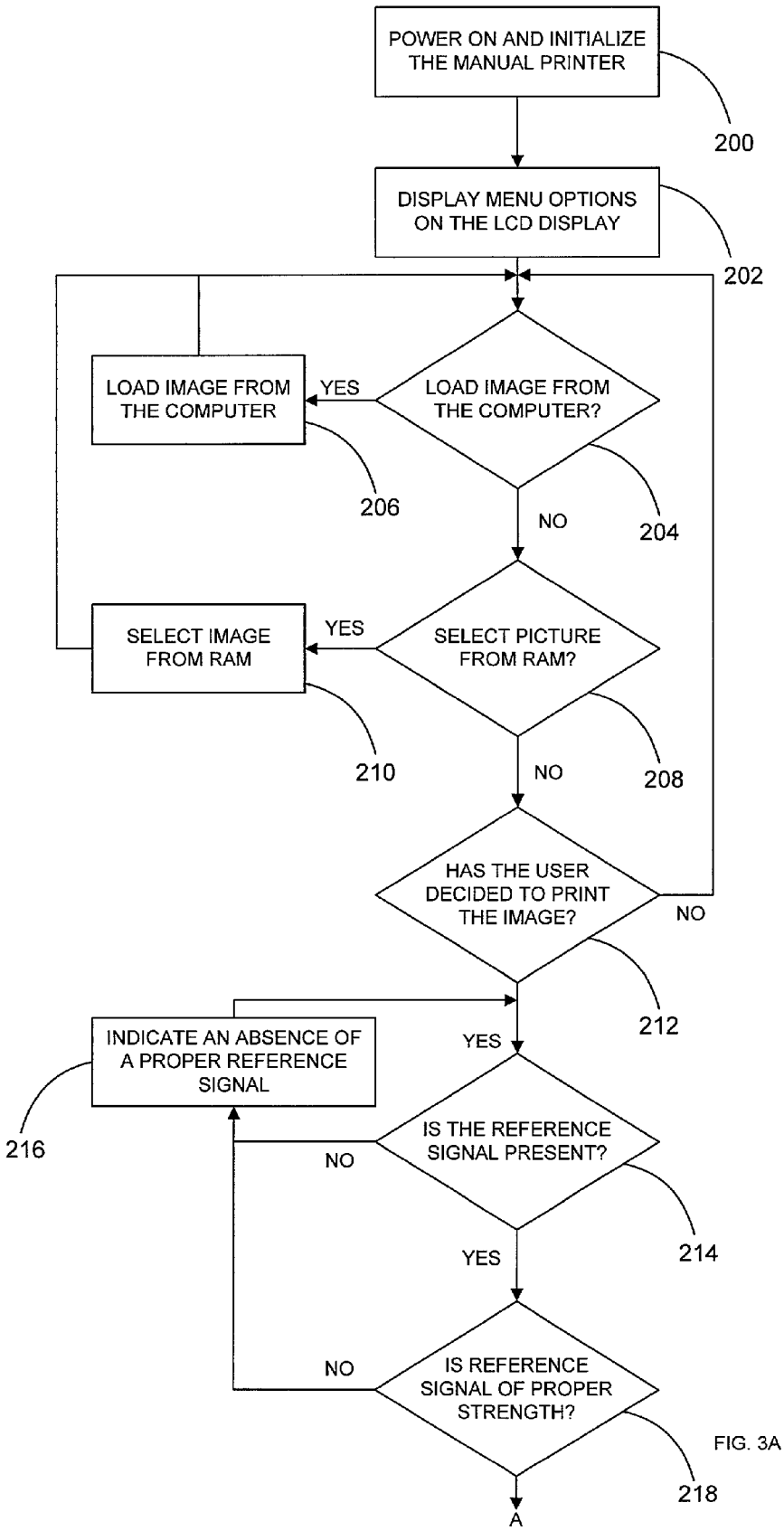
FIGS. 3A–3C show a high level flow diagram of a method for using an embodiment of the manual printer.
Figure 3B:
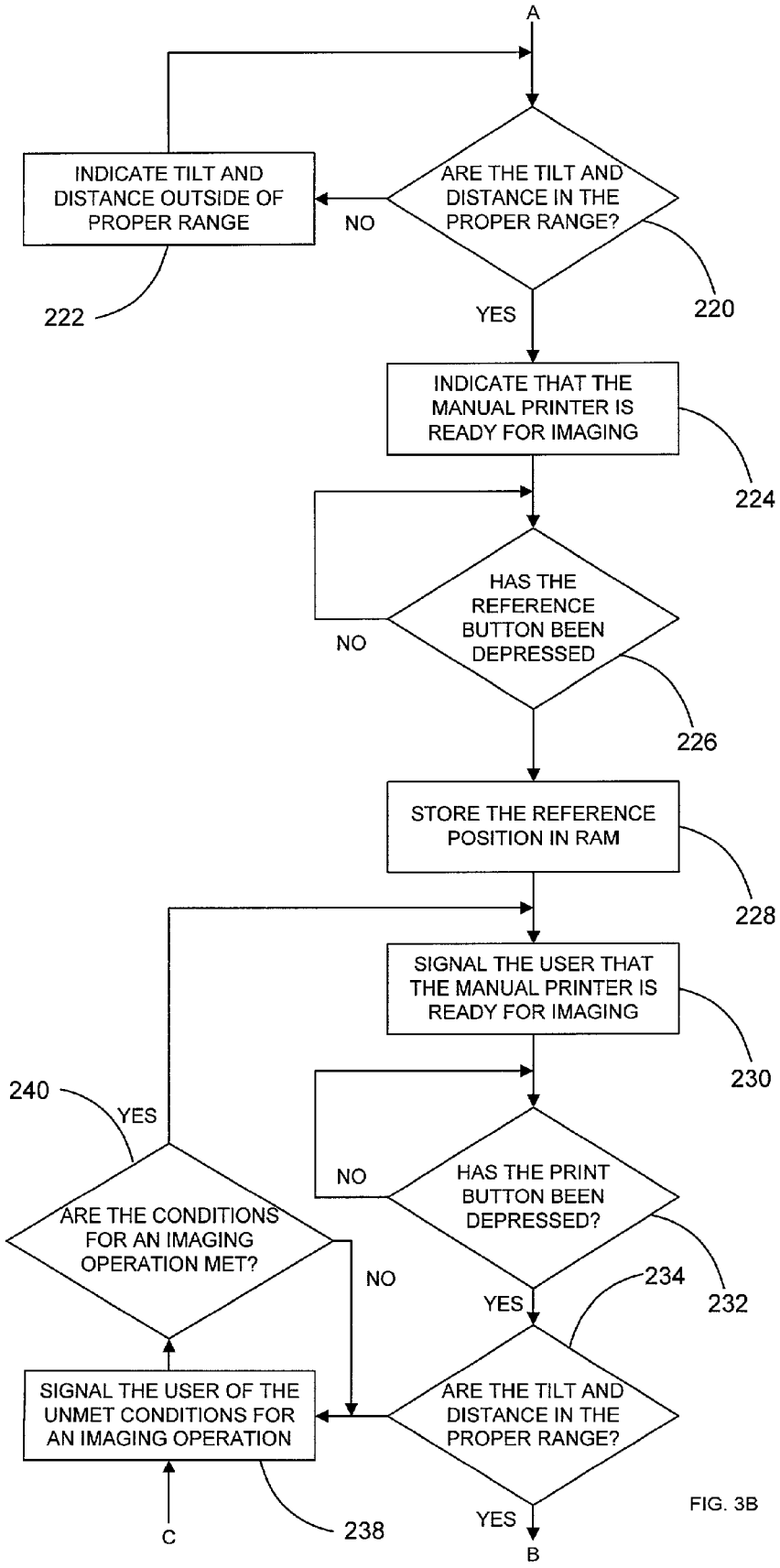
Figure 3C:
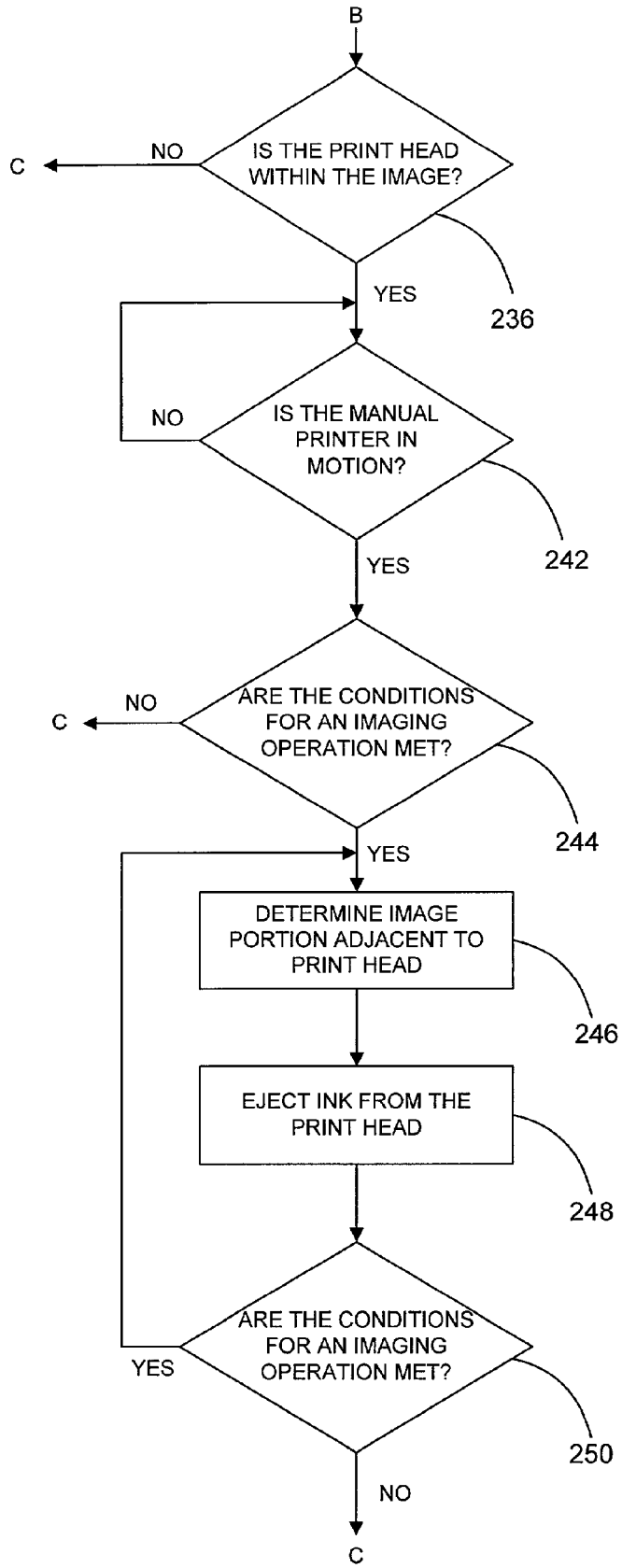

Shown in FIG. 3A through FIG. 3C is a high level flow diagram of a method for using manual printer 10 to form an image on object 14. In step 200, manual printer 10 is powered on and initialized. Then, in step 202, menu options are displayed on LCD display 26 to allow the user to select. Next, in step 204, manual printer 10 decides if the user selects loading of an image from an external source, such as a computer. If an image is to be loaded, then, in step 206, the image is loaded and control is returned to step 204. If an image will not be loaded, then, in step 208, manual printer 10 decides if the user selects an image stored in RAM 114. If this is the case, then in step 210, the image stored in RAM 114 is selected and control is returned to step 204. If this is not the case, then, in step 212, manual printer 10 decides if the user has decided to print the previously selected or loaded image.

Next, in step 214, manual printer 10 determines if the signal from emitter 24 used to determine the location of manual printer 10 is present. If the signal is not present, then, in step 216, manual printer 10 indicates to the user through LCD display 26 that the signal from emitter 24 has not been detected. If the signal is detected, then, in step 218, manual printer 10 determines if the signal provided by emitter 24 is sufficiently strong. If it is not, then control is returned to step 216. If it is, then, in step 220, manual printer 10 determines if the tilt with respect to the surface and the distance above the surface of manual printer 10 is within an acceptable range for forming an image on object 14. If the tilt and the distance above the surface are not within an acceptable range, then, in step 222, manual printer 10 indicates to the user through LCD display 26 that the tilt or distance are not proper and control is returned to step 220.

If the tilt and distance are within an acceptable range, then, in step 224, manual printer 10 indicates to the user that it is ready to perform the imaging operation. Next, in step 226, manual printer 10 determines if the user has depressed button 30 to establish a reference location. If button 30 has not been depressed, microprocessor 112 continues to poll hardware to determine if button 30 has been depressed. If microprocessor 112 detects the depression of button 30, then, in step 228, microprocessor 112 determines the reference position and stores the reference position in RAM 114. Next, in step 230, manual printer 10 signals the user through LCD display 26 that manual printer 10 is ready to commence with forming an image.

There are several conditions that must occur for an imaging operation to proceed. If any of these conditions are not initially met or are no longer met after an imaging operation begins, manual printer 10 will not begin ejecting onto object 14 or will cease ejecting ink onto object 14. These conditions include depression of button 28, the tilt of manual printer 10 within a maximum tilt value, the distance of manual printer 10 from the surface of object 14 within a maximum value, the position of manual printer 10 with respect to the boundaries of the image, and the movement of manual printer 10. For convenience, these conditions will be referred to collectively as the minimum criteria for performing an imaging operation at places within the high level flow diagram.

It should be recognized that other embodiments of the manual imaging device may have different minimum criteria for performing an imaging operation, depending upon the specific characteristics of the embodiment of the imaging device. For alternate embodiments of the manual imaging device some of the specific values of the criteria may be different or some criteria may not be included in the minimum criteria. For example, an alternate embodiment of the imaging device may have different acceptable limits on the tilt, or distance from the surface of the object, or may not require depressing a button to initiate an imaging operation.

In step 232 (as part of determining if the minimum criteria for forming an image are met), microprocessor 112 polls the hardware to determine if button 28 is actuated. Depression of button 28 is used to initiate an imaging operation. If microprocessor 112 determines that button 28 is not actuated, it continues to poll the hardware. If microprocessor 112 determines that button 28 is actuated, then, in subsequent steps, each of the remaining minimum criteria are checked to see if the conditions for forming an image on object 14 are met.

In step 234, microprocessor 112 determines if the positioning of manual printer 10 with respect to its tilt and distance from the surface of object 14 meets the criteria for performing an imaging operation. If the tilt and distance minimum criteria are met, then, in step 236, microprocessor 112 determines if print head 12 of manual printer 10 is within the boundaries of the image that is to be formed on the surface of object 14, as determined from the reference position determined in step 228. If microprocessor 112 determines that print head 12 is outside of the boundaries of the image, then, in step 238, microprocessor 112 signals the user through LCD display 26 that print head 12 is outside of the boundaries of the image that is to be formed. LCD display 26 could be used to show the position of print head 12 relative to the boundary of the image to provide visual feedback to the user on how manual printer 10 needs to be moved. If, in step 234, microprocessor 112 determines that the tilt or distance minimum criteria are not met, then, control is passed to step 238. In step 238, microprocessor 112 signals the user through LCD display 26 that either or both of the tilt and distance requirements are not met. LCD display 26 could be used to visually indicate the change in tilt or distance required to meet the minimum criteria for forming an image.

Next, in step 240, microprocessor 112 determines if the minimum criteria for performing an imaging operation are met. If one or more of the previously mentioned minimum criteria for performing an imaging operation have not been met, then control is returned to step 238. In step 238, the user is informed of which of the minimum criteria are not met to allow the user to make the necessary adjustments so that the minimum criteria for performing an imaging operation are met. In the case in which control is passed to step 238 from step 236, the user will be informed that the unmet minimum criteria relates to the position of print head 12 relative to the boundary of the image. In the case in which control is passed to step 238 from step 234, the user will be informed that the unmet minimum criteria relates to the tilt or distance of manual printer 10 relative to object 14. If the user has made the adjustments manual printer 10 so that the minimum criteria for forming an image are met, then control is transferred back to step 230.

If in step 236, microprocessor 112 determines that print head 12 is within the boundaries of the image that will be formed on the surface of object 14, then, in step 242, microprocessor 112 determines if manual printer 10 is in motion using the signal from emitter 24. If manual printer 10 is not in motion, then microprocessor 112 continues to monitor the signal from emitter 24 to determine if it is in motion. If manual printer 10 is in motion, then, in step 244, microprocessor 112 determines if the minimum criteria for forming an image are met. If the minimum requirements are not met, then control is returned to step 238 and the user is signaled through LCD display 26 of the minimum criteria for an imaging operation that are not met.

If microprocessor 112 determines, in step 244, that the minimum criteria for performing an imaging operation are met, then, in step 246, microprocessor 112 determines the portion of the image corresponding to the location on object 14 to which print head 12 is adjacent. Next, in step 248, print head 12 is controlled to eject the ink to form the part of the image corresponding to the location to which print head 12 is adjacent. While the image is formed, microprocessor 12, in step 250, is checking each of the minimum criteria for forming an image. If they are met control is returned to step 246 to continue forming an image. If one or more of these minimum criteria for forming an image are not met control is returned to step 238.

Although an embodiment of the manual printer has been illustrated and described, it should be recognized that various modifications may be made to this embodiments without departing from the spirit of the invention or from the scope of the appended claims.

What is claimed is:

1. A manual imaging system, comprising:

an emitting device configured to emit a radiated signal;

a receiving element arranged to receive the radiated signal;

a memory to store image data;

an imaging mechanism configured to place colorant onto an object according to data related to the image data, with the radiated signal indicative of a position of the imaging mechanism relative to a reference point; and a processing device arranged to receive a representation of the radiated signal and configured to selectively send the data to the imaging mechanism using the representation and selectively receive the image data from the memory.

2. The manual imaging system as recited in claim 1, wherein:

the imaging mechanism includes an imaging head interface arranged to receive the data and configured to generate a plurality drive signals using the data; and the imaging mechanism includes an imaging head configured to place the colorant onto the object according to the plurality of drive signals.

3. The manual imaging system as recited in claim 2, further comprising:

a converter coupled between the receiving element and the processing device and configured to generate the representation from the radiated signal where the representation includes a digital representation.

4. The manual imaging system as recited in claim 3, further comprising:

a display interface arranged to receive image data from the processing device and configured to generate display data from the image data; and a display to display an image corresponding to the display data.

5. The manual imaging system as recited in claim 4, wherein:

the imaging head includes a first print head for placing cyan colorant onto the object, a second print head for placing magenta colorant onto the object, a third print head for placing yellow colorant onto the object, and a fourth print head for placing black colorant onto the object according to the plurality of drive signals.

6. The manual imaging system as recited in claim 5, further comprising:

a first sensor to measure a distance between a surface of the object and the imaging head;

a second sensor to measure an acceleration of the imaging head;

a third sensor to measure an angle between an axis of the imaging head and the surface; and a multiplexer coupled between the converter and the receiving element to selectively connect a first component, a second component, or a third component comprising the radiated signal to the converter.

7. The manual imaging system as recited in claim 6, wherein:

the receiving element includes a first receiving element, a second receiving element, and a third receiving element configured to receive, respectively the first component, the second component, and the third component; and the processing device includes a microprocessor configured to execute instructions to selectively send the data to the imaging head interface and the image data to the display interface, and configured to execute instructions to compute a position of the imaging head with respect to a reference location and determine the suitability of the position, the distance, the acceleration, and the angle for placing the colorant onto the object.

8. The manual imaging system as recited in claim 2, wherein:

the emitting device includes a first radiator located at a first position to radiate a first component of the radiated signal and a second radiator located at a second position to radiate a second component of the radiated signal; and the processing device includes a configuration to determine a position in space using the first component and the second component.

9. A manual imaging device, comprising:

a receiving element arranged to receive a radiated signal indicative of a position of the manual imagine device relative to a reference point;

a memory to store image data;

an imaging head configured to place ink onto an object according to a plurality of drive signals;

an imaging head interface arranged to receive data related to the image data and configured to generate the plurality of drive signals using the data;

a processor arranged to receive a representation of the radiated signal and configured to selectively send the data to the imaging head interface using the radiated position signal and selectively receive the image data from the memory.

10. The manual imaging device as recited in claim 9, wherein:

the imaging head includes a first print head for placing cyan ink onto the object, a second print head for placing magenta ink onto the object, a third print head for placing yellow ink onto the object, and a fourth print head for placing black ink onto the object.

11. The manual imaging device as recited in claim 10, further comprising:

a first sensor coupled to the processor and configured to measure a distance between a surface of the object and the imaging head;

a second sensor coupled to the processor and configured to measure an acceleration of the imaging head;

a third sensor coupled to the processor and configured to measure an angle between an axis of the imaging head and the surface;

a converter coupled to the processor and configured to generate the representation of the radiated signal;

a multiplexer coupled between the converter and the receiving element to selectively connect a first signal, a second signal, or a third signal comprising the radiated signal to the converter;

a display interface arranged to receive image data from the processor and configured to generate display data from the image data; and a display to display an image corresponding to the display data.

* * * * *